United States Patent [19]

Vrijssen et al.

[11] Patent Number: 4,684,994

[45] Date of Patent: Aug. 4, 1987

[54] TELEVISION CAMERA TUBE WITH HONEYCOMB GRID ELECTRODE

[75] Inventors: Gerardus A. H. M. Vrijssen; Aart A. Van Gorkum, both of Eindhoven, Netherlands

[73] Assignee: U.S. Philips Corporation, New York, N.Y.

[21] Appl. No.: 818,154

[22] Filed: Jan. 13, 1986

[30] Foreign Application Priority Data

Feb. 7, 1985 [NL] Netherlands ..... 8500340

[51] Int. Cl.[4] ..... H01J 29/02; H01J 29/06

[52] U.S. Cl. ..... 358/217; 313/348; 313/390

[58] Field of Search ..... 358/217, 218, 219, 220, 358/209; 313/390, 348

[56] References Cited

U.S. PATENT DOCUMENTS

| | | | |
|---|---|---|---|
| 2,247,138 | 6/1941 | Sukumlyn | 358/217 |
| 3,107,313 | 10/1963 | Hechtel | 313/348 |
| 3,109,116 | 10/1963 | Epstein et al. | 313/348 |
| 3,109,117 | 10/1963 | Kaplan | 313/348 |
| 3,240,987 | 3/1966 | Hicks, Jr. | 313/348 |
| 3,358,175 | 12/1967 | Morrell et al. | 313/348 |
| 4,120,002 | 10/1978 | Lieber | 358/209 |
| 4,607,190 | 8/1986 | Himmelbauer | 313/390 |

*Primary Examiner*—Gene Z. Rubinson
*Assistant Examiner*—Stephen Brinich
*Attorney, Agent, or Firm*—Marc D. Schechter

[57] ABSTRACT

A television camera tube comprising in an evacuated envelope, an electron gun for generating at least one electron beam. The electron beam is focused onto a target, and is deflected over the target. A grid electrode having hexagonal apertures is provided in front of the target.

The apertures in the grid electrode are arranged in a honeycomb structure. Each aperture has the form of an equilateral hexagon having angles of 120°. As a result, the susceptibility to Moiré effects is reduced, the microphonic properties are improved, and the mesh obtained has a high transmissivity while it can more readily be tensioned and is easier to handle.

5 Claims, 2 Drawing Figures

TELEVISION CAMERA TUBE WITH HONEYCOMB GRID ELECTRODE

BACKGROUND OF THE INVENTION

The invention relates, to a television camera tube comprising, in an evacuated envelope, an electron gun for generating at least one electron beam. The electron beam is focused onto a target having a photosensitive layer. The beam is deflected over the target. A grid electrode having hexagonal apertures is provided directly in front of the target.

Such a television camera tube is described in Japanese Kokai No. 58-7752. In the tube described therein, a grid electrode is provided a few millimeters away from the photosensitive layer. The electric field between the grid electrode and the photosensitive layer ensures that the electron beam lands on the target substantially perpendicularly over the entire photosensitive layer.

Moiré effects, which arise when the grid electrode is scanned by an electron beam along a line pattern, are less liable to occur if the apertures in the grid electrode are hexagonal. However, the process of imparting a hexagonal shape to the apertures, as described in Japanese Kokai No. 58-7752 which is considered to be incorporated herein by reference, results in a reduction of the electron transmission as compared with the transmission of the commonly used grid electrode having square apertures.

The grid electrode is tensioned in order to reduce microphonics in the tube. The maximum tension is then limited by the tensile strength of the grid electrode.

SUMMARY OF THE INVENTION

It is an object of the invention to provide a television camera tube in which the electron transmission of the grid electrode is at least equal to the electron transmission of a grid electrode comprising a mesh having square apertures but equal pitch. Another object of the invention is to provide a television camera tube having improved microphonic properties.

According to the invention, in a television camera tube the apertures in the grid electrode are arranged in a honeycomb structure (a dense structure of hexagonal apertures). The apertures are equilateral hexagons with angles of 120° (i.e. regular hexagons). If the pitch and the wire width remain the same, the transmission of a grid electrode having a honeycomb structure is equal to that of an electrode having square apertures.

The grid electrode as shown in Japanese Kokai No. 58-7752, just like grid electrodes having square apertures, has two mutually perpendicular directions in which its strength is greatest. Moreover, the wires of two adjacent apertures adjoin each other.

In contrast, the grid electrode according to the invention has three directions in which the strength of the electrode is greatest. Moreover, the wires which extend in one direction are coaxial, but they are not interconnected. This results in a better distribution of the mechanical stress in the grid electrode, consequently, the microphonic properties improve and the stress may be higher.

This hexagonal pattern therefore results in a grid electrode of great strength. Consequently, a mesh having hexagonal apertures according to the invention can more easily be tensioned in an electrode support without damaging the mesh. The increased strength makes it possible to reduce the widths of the wires, which results in a greater transmission.

A type of mesh which is very suitable for use in television camera tubes has apertures in the grid electrode with a pitch between 10 and 50 μm, preferably approximately 17 μm. The widths of the wires are between 2 and 6 μm, preferably approximately 4 μm. A mesh aperture of 17 μm and a wire width of 4 μm corresponds to a transmission of 60% in the case of 1500 lines per inch (60 lines/mm). The grid electrode is preferably made of a material or an alloy from the group formed by nickel, copper, platinum, and gold.

Such a grid electrode can be made by a method described in British Pat. No. 2,063,299 which is considered to be incorporated herein by reference. This method employs a mold in which grooves, having depths corresponding to the desired electrode thicknesses are formed by a photolithographic process in a pattern which is a negative of the desired mesh pattern. The mesh is formed in the grooves by electrodeposition, after which it is removed from the mold.

A variant of this known method uses a mold of non-conductive material, particularly quartz glass, in which the requisite groove pattern is RF-sputter etched. Subsequently, the bottom of the grooves is rendered electrically conductive by sputter depositing with metallic palladium, silver or silver-palladium alloys, the excess of which is then ground off the surface, leaving only metal in the grooves. Next, the electrode is formed by electrodeposition, and is thereafter removed from the mold.

Electrodes having a honeycomb structure are stronger than square-aperture electrodes having the same wire width. Consequently, the former can more readily be stripped off the mold without cracking the electrode, even when the wires are thinner.

Another variant of the known method employs a mold of a semiconductor material, namely a single crystal silicon wafer. A silicon oxide layer is vapor deposited thereon by a chemical process (CVD). Subsequently, by applying a photoresist and etching with a hydrofluoric acid solvent in a photolithographic process, the silicon oxide layer is formed into a mask whose pattern is the negative of the desired groove pattern.

Using a boiling NaOH solution, the silicon is etched to a depth of 5 μm via this mask. Subsequently in the same manner described above, the electrode is formed in the mold pattern by electrodeposition, and is subsequently removed from the mold.

This method, however, is rather complicated and time-consuming. For each individual electrode, the vacuum sputtering process and the removal of the excess metal have to be repeated.

U.S. Pat. No. 3,878,061, which is considered to be incorporated herein by reference, discloses a method which is much simpler and which employs a mold for developing the grid electrode. The mold can be used several times without requiring any intermediate treatment. For this purpose, the grooves in the mold have side walls which are not electrically conductive and have bottoms which are electrically conductive.

DESCRIPTION OF THE PREFERRED EMBODIMENTS

Figure 1:
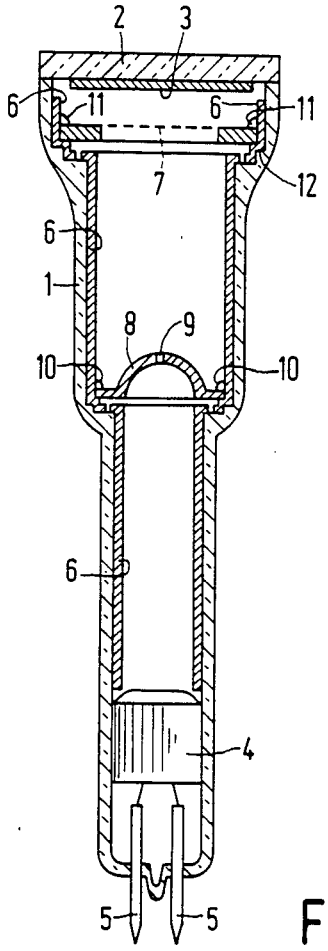
FIG. 1 is a cross-sectional view of a television camera tube according to the invention.

The television camera tube shown in FIG. 1 comprises a glass envelope 1 which is closed at one end by a glass disc 2 having a target 3. In the tube there is an electron gun 4 to which the desired voltages can be applied via a number of lead-through pins 5. The inner wall of the envelope 1 is coated with a thin nickel layer 6 by a known process, such as electroless nickel plating.

The tube further comprises a grid electrode 7 of nickel, and a diaphragm 8 having an opening 9. The electron beam generated by the electron gun 4 passes through grid electrode 7 and diaphragm 8 prior to landing on the photosensitive layer 3.

The nickel layer 6 is interrupted near the grid electrode 7 and near the diaphragm 8 completely therearound so that the layer 6 is divided into three parts. Each of these parts forms a wall electrode which contributes to the formation of a footprint of the electron beam on the photosensitive layer 3 of desired form and dimensions.

By using indium balls 10 and 11, the grid electrode 7 which is tensioned in an annular supporting member and the diaphragm 8 are mechanically and electrically connected to the nickel layer 6 at the sides facing away from the hearing surface.

Figure 2:
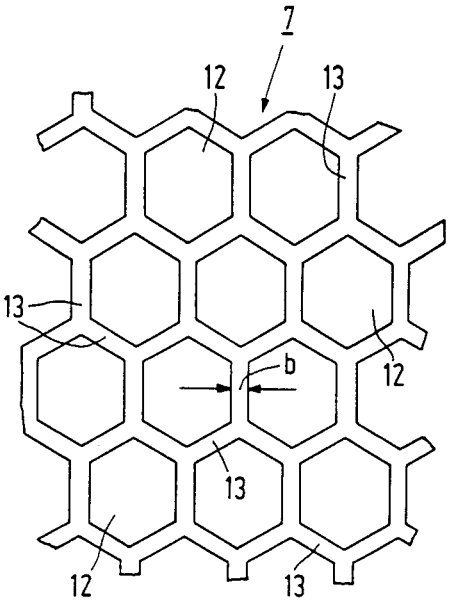
FIG. 2 schematically shows a part of a grid electrode having a honeycomb structure, for use in a television camera tube according to the invention.

FIG. 2 shows a part of the grid electrode 7 having apertures 12 which are arranged in a honeycomb structure. The apertures 12 have the form of equilateral hexagons having sides of 16 μm and angles of 120°. The width b of each wire 13 is, in this case, 6 μm. The apertures have a pitch of 34 μm, and consequently the transmission is 68%. The thicknesses of the wires is 4 μm.

What is claimed is:

1. A television camera tube comprising:

an evacuated envelope;

an electron gun in the envelope for generating an electron beam;

a target in the envelope, said target bearing a photosensitive layer, said target arranged to be scanned by the electron beam; and a grid electrode arranged near but spaced from the target between the electron gun and the target, said grid electrode having a plurality of regular hexagonal apertures therein forming a honeycomb structure.

2. A television camera tube as claimed in claim 1, characterized in that:

each aperture in the grid electrode has a pitch between 10 and 50 microns; and the grid comprises wires arranged between the apertures, each wire having a width from 2 to 6 microns.

3. A television camera tube comprising:

an evacuated envelope;

an electron gun in the envelope for generating an electron beam;

a target in the envelope, said target bearing a photosensitive layer, said target arranged to be scanned by the electron beam; and a grid electrode arranged near but spaced from the target between the electron gun and the target, said grid electrode having a plurality of apertures therein forming a honeycomb structure, each aperture being a regular hexagon.

4. A television camera tube as claimed in claim 3, characterized in that:

each aperture in the grid electrode has a pitch between 10 and 50 microns; and the grid comprises wires arranged between the apertures, each wire having a width from 2 to 6 microns.

5. A television camera tube comprising:

an evacuated envelope;

an electron gun in the envelope for generating an electron beam;

a target in the envelope, said target bearing a photosensitive layer, said target arranged to be scanned by the electron beam; and a grid electrode arranged near but spaced from the target between the electron gun and the target, said grid electrode having a plurality of regular hexagonal apertures therein forming a honeycomb structure, said grid electrode being mounted in tension in an annular supporting member.

* * * * *